US011819850B2

(12) United States Patent
Suzuki

(10) Patent No.: US 11,819,850 B2
(45) Date of Patent: Nov. 21, 2023

(54) FLUID HANDLING DEVICE

(71) Applicant: Enplas Corporation, Saitama (JP)

(72) Inventor: Seiichiro Suzuki, Saitama (JP)

(73) Assignee: Enplas Corporation, Saitama (JP)

( * ) Notice: Subject to any disclaimer, the term of this patent is extended or adjusted under 35 U.S.C. 154(b) by 161 days.

(21) Appl. No.: 17/318,002

(22) Filed: May 12, 2021

(65) Prior Publication Data

US 2022/0362775 A1 Nov. 17, 2022

(51) Int. Cl.
*B01L 3/00* (2006.01)

(52) U.S. Cl.
CPC ..... *B01L 3/502784* (2013.01); *B01L 3/50273* (2013.01); *B01L 2400/0487* (2013.01)

(58) Field of Classification Search
CPC ..... B01L 3/502784
See application file for complete search history.

(56) References Cited

U.S. PATENT DOCUMENTS

2004/0068019 A1 4/2004 Higuchi et al.

FOREIGN PATENT DOCUMENTS

WO WO 02/068104 9/2002

OTHER PUBLICATIONS

Jiang et al., "Drop impact on superhydrophobic surface with protrusions", 2019, Chemical Engineering Science, 212, 115351 (Year: 2019).*

* cited by examiner

*Primary Examiner* — Jennifer Wecker
*Assistant Examiner* — Mickey Huang

(57) ABSTRACT

A fluid handling device includes a sample channel configured to carry a sample; a dispersion medium channel configured to carry dispersion medium; a dispersion liquid generation part connected to the sample channel and the dispersion medium channel, and configured to generate dispersion liquid by dividing the sample by the dispersion medium, the dispersion liquid being liquid in which droplets of the sample are dispersed in the dispersion medium; and a dispersion liquid channel connected to the dispersion liquid generation part. The dispersion liquid generation part includes a protrusion.

4 Claims, 6 Drawing Sheets

FLUID HANDLING DEVICE

TECHNICAL FIELD

The present invention relates to a fluid handling device.

BACKGROUND ART

In clinical, food and environmental testing and the like, highly accurate analysis of trace amounts of analytes such as cells, proteins, and nucleic acids is often required. One of the methods for analyzing minute analytes is to generate tiny droplets with a diameter of 0.1 to 1,000 μm from a liquid containing the analyte, and to observe and analyze them.

The droplets can be generated by producing a flow a dispersion medium (e.g., oil) sandwiching the flowing sample to divide the flowing sample. For example, PTL 1 discloses a method of generating droplets by discharging a dispersed phase in an intersecting direction for a continuous phase flowing in a microchannel.

CITATION LIST

Patent Literature

PTL 1
WO2002/068104

SUMMARY OF INVENTION

Technical Problem

FIG. 1 illustrates how droplets are generated in a device such as that illustrated in PTL 1. In FIG. 1, the droplets are generated by dividing the sample flowing from the sample channel 112 with the dispersion medium flowing from the dispersion medium channel 114. In general, a droplet generating device (fluid handling device) is required to be able to generate droplets stably.

However, in the device illustrated in PTL 1, for example, as illustrated in FIG. 2, even if a dispersion medium flowing in dispersion medium channel 114 is mixed with a sample flowing in sample channel 112 in a sandwiching manner, the sample is not divided and the sample flows as a laminar flow along the wall of the channel, and droplets are not generated. In particular, when the viscosity of the sample is high, the sample often flows in a laminar manner along the wall.

In view of this, an object of the present invention is to provide a fluid handling device that can generate droplets more stably.

Solution to Problem

The present invention provides the following fluid handling device.

A fluid handling device includes a sample channel configured to carry a sample; a dispersion medium channel configured to carry dispersion medium; a dispersion liquid generation part connected to the sample channel and the dispersion medium channel, and configured to generate dispersion liquid by dividing the sample by the dispersion medium, the dispersion liquid being liquid in which droplets of the sample are dispersed in the dispersion medium; and a dispersion liquid channel connected to the dispersion liquid generation part. The dispersion liquid generation part includes a protrusion.

Advantageous Effects of Invention

According to the present invention, it is possible to provide a fluid handling device that can generate droplets more stably.

DESCRIPTION OF EMBODIMENTS

Figure 1:
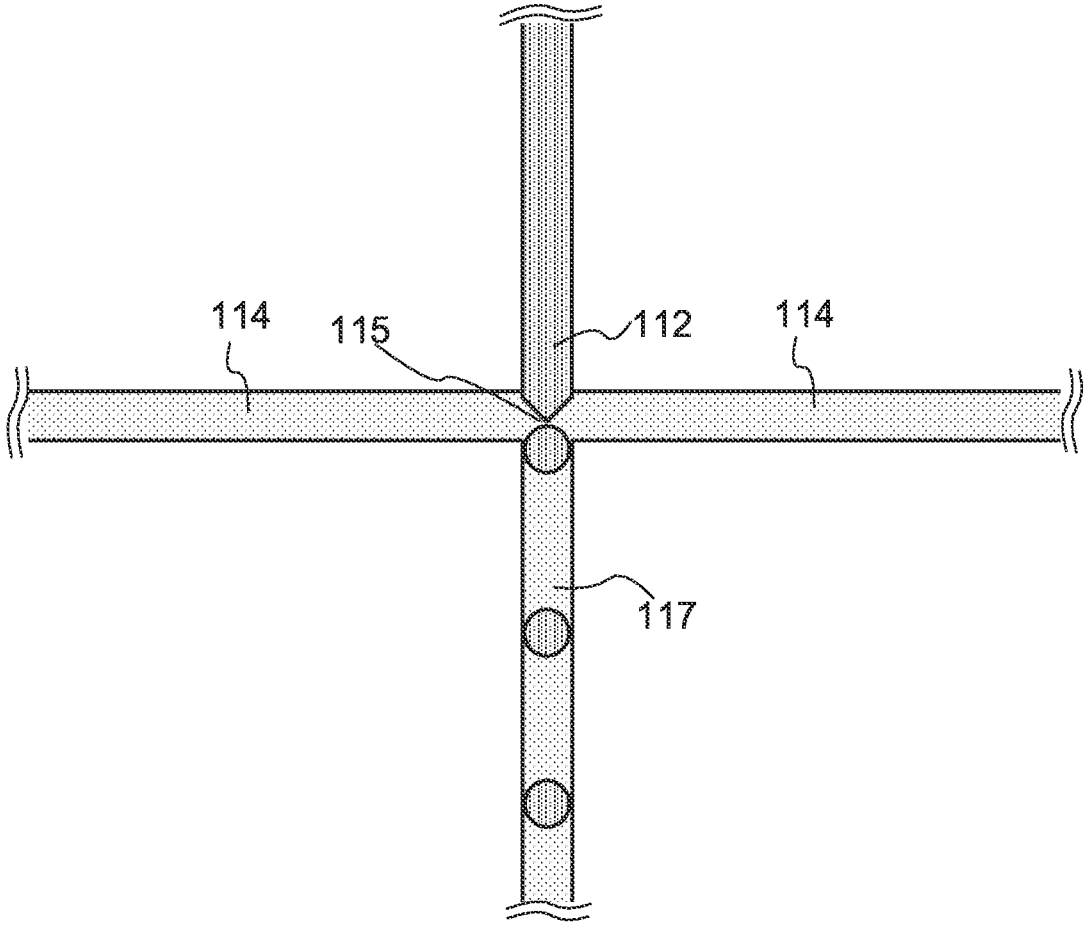
FIG. 1 illustrates a state where droplets are generated in a conventional fluid handling device.

An embodiment of the present invention is elaborated below with reference to the accompanying drawings. Note that the dimensions or proportions of dimensions illustrated in the drawings may differ from the actual dimensions or proportions of dimensions for clarity of description.

Fluid Handling Device

Figure 3A:
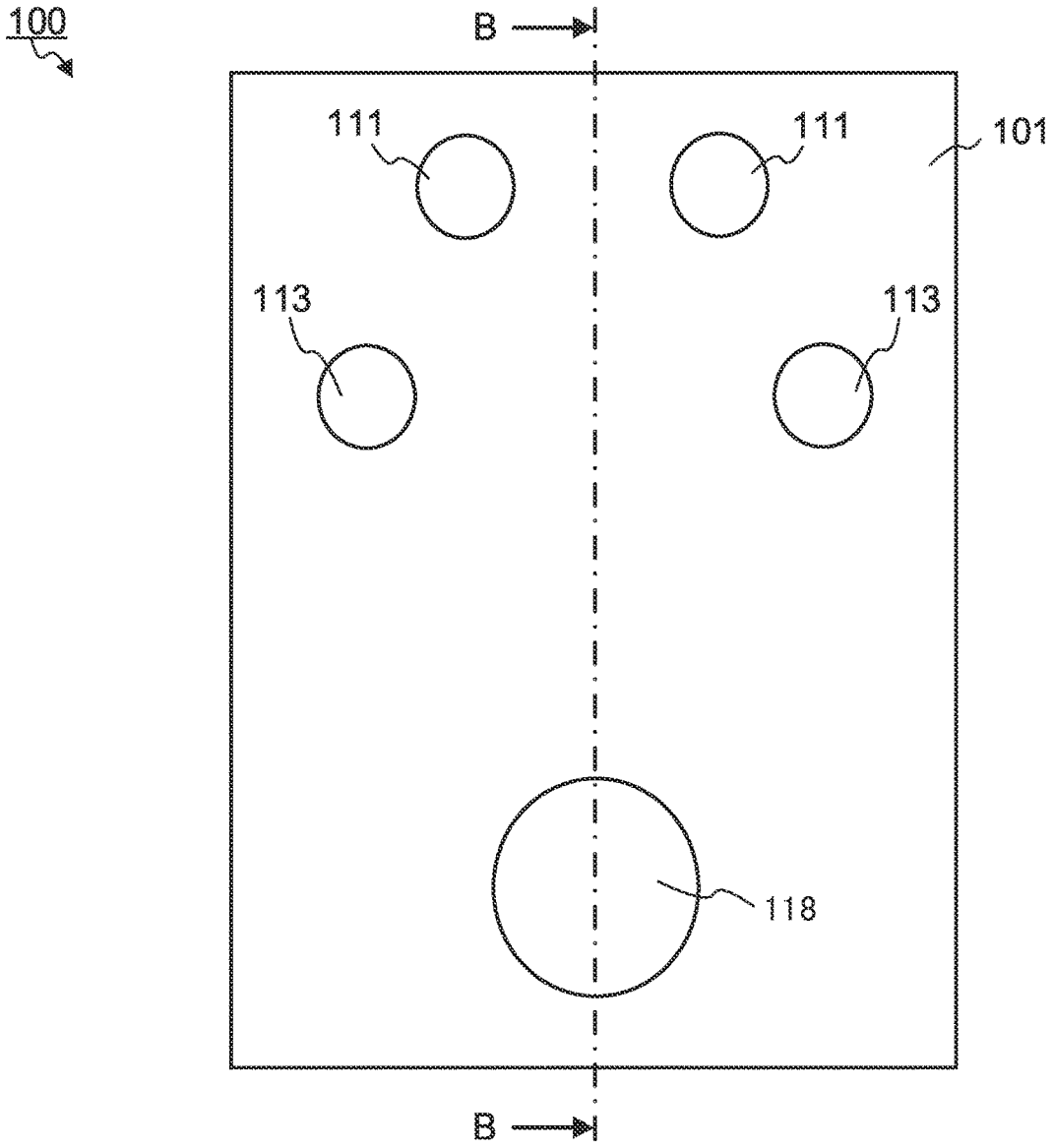
FIG. 3A is a plan view of a fluid handling device according to an embodiment of the present invention.
Figure 3B:
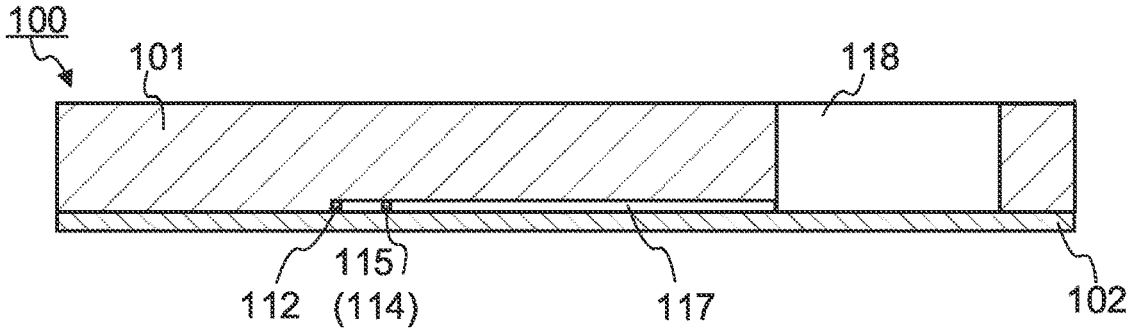
FIG. 3B is a sectional view taken along line B-B of FIG. 3A.
Figure 4:
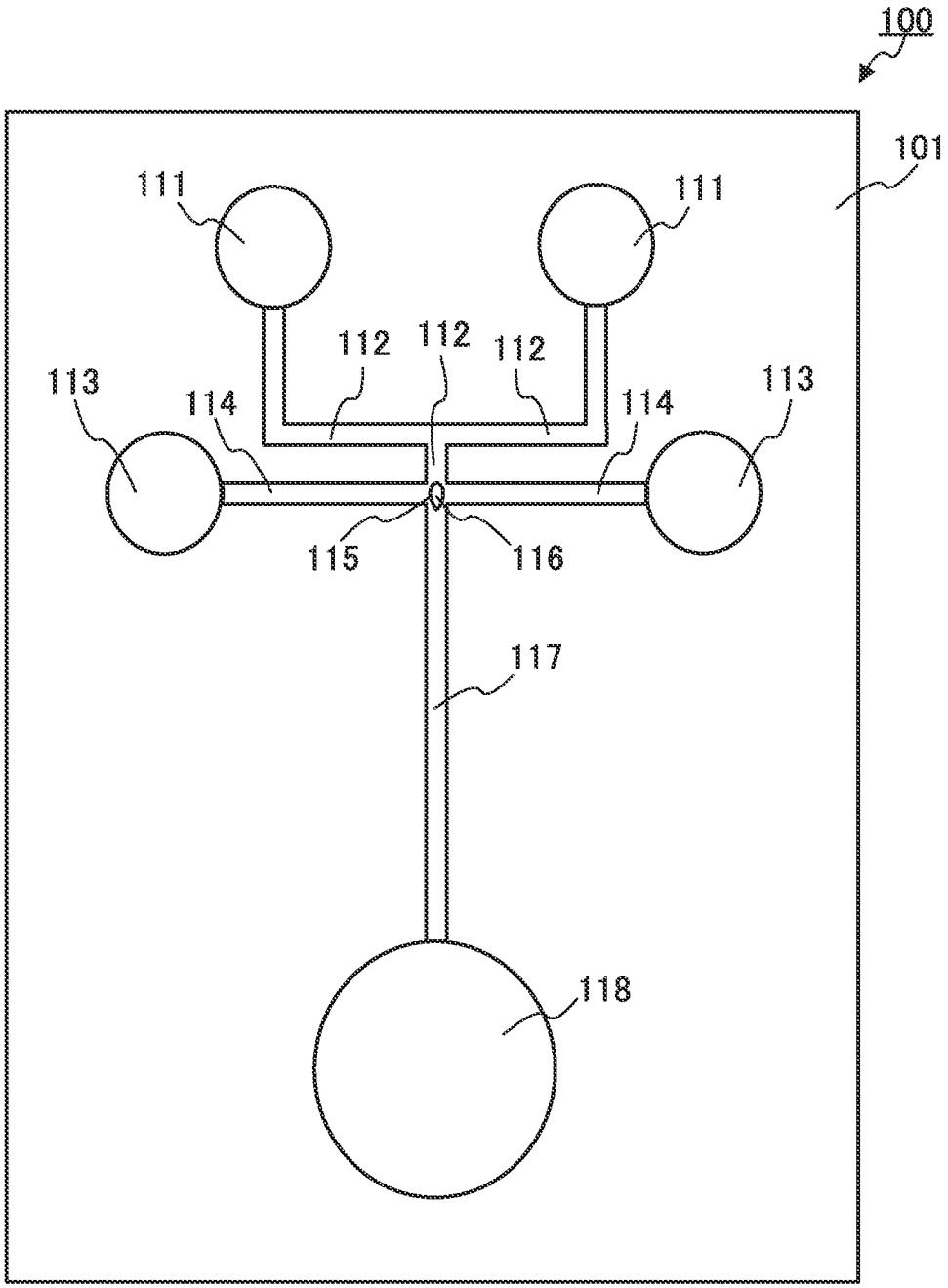
FIG. 4 is a bottom view of a substrate of the fluid handling device according to the embodiment of the present invention.
Figure 5:
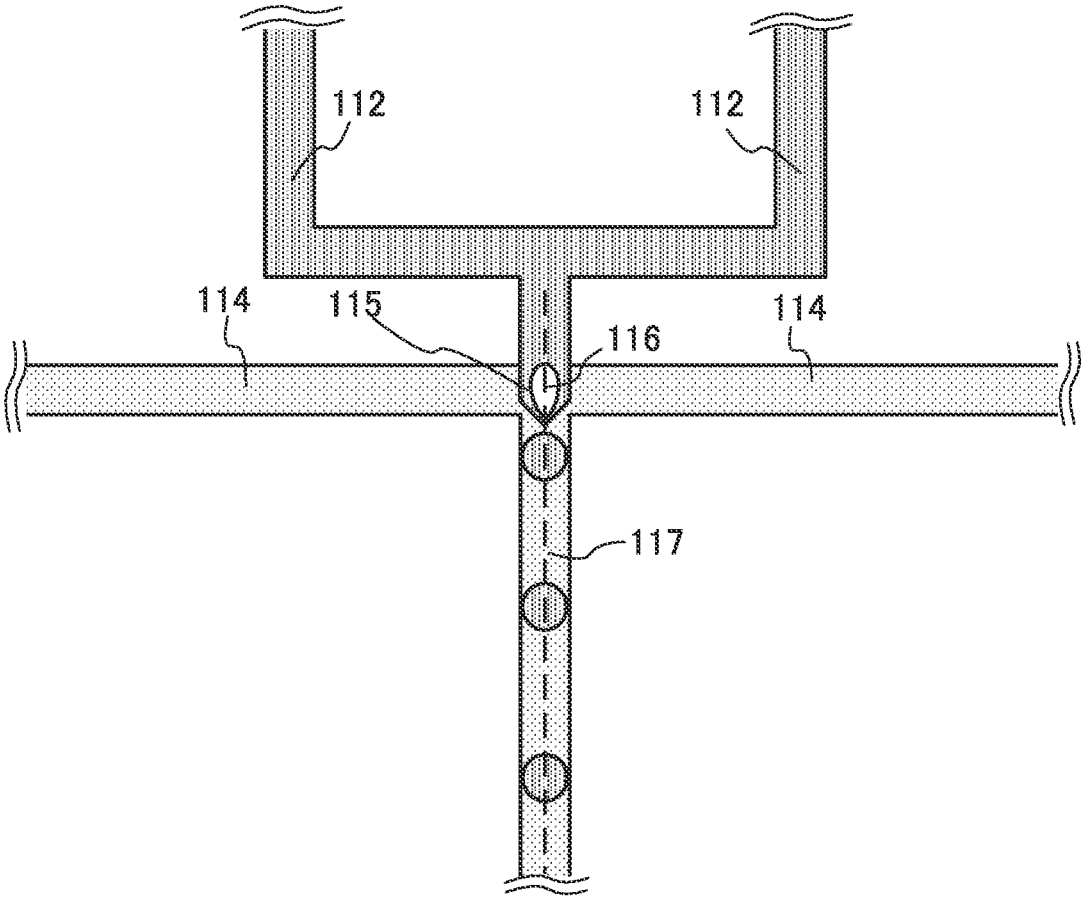
FIG. 5 illustrates a state where droplets are generated in the fluid handling device according to the embodiment of the present invention.
Figure 6A:
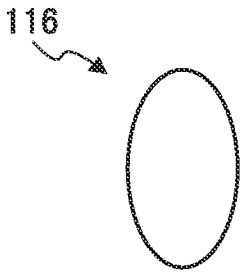
FIGS. 6A, 6B, 6C, 6D, 6E, 6F, 6G, 6H and 6I illustrate examples of a shape of a protrusion.
Figure 6B:
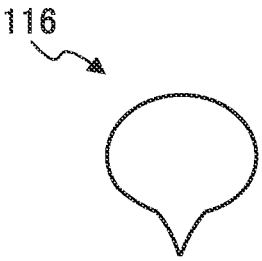
Figure 6C:
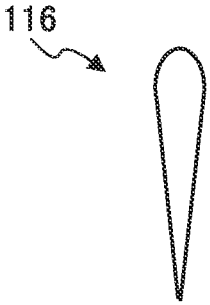
Figure 6D:
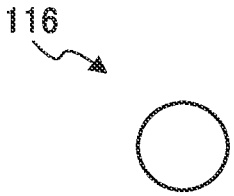
Figure 6E:
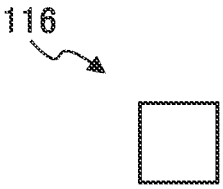
Figure 6F:
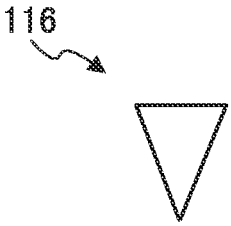
Figure 6G:
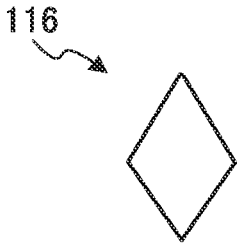
Figure 6H:
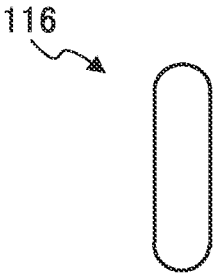
Figure 6I:
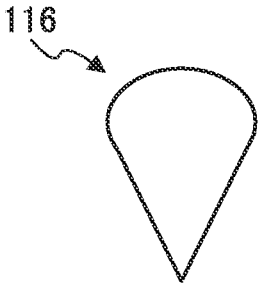

FIG. 3A is a plan view of fluid handling device 100 according to an embodiment of the present invention, and FIG. 3B is a sectional view taken along line B-B of FIG. 3A. FIG. 4 is a bottom view of substrate 101 of fluid handling device 100, and FIG. 5 is an enlarged view of dispersion liquid generation part 115.

As illustrated in FIG. 3B, fluid handling device 100 according to the embodiment of the present invention is composed of substrate 101 in which grooves and through holes are formed, and film 102 joined to one surface of substrate 101 so as to close the openings of the grooves and through holes. As illustrated in FIGS. 3A to 5, fluid handling device 100 includes sample introduction part 111, sample channel 112, dispersion medium introduction part 113, dispersion medium channel 114, dispersion liquid generation part 115, dispersion liquid channel 117, and dispersion liquid collection part 118. As described later, dispersion liquid generation part 115 includes protrusion 116. Note that sample introduction part 111, dispersion medium introduction part 113, and dispersion liquid collection part 118 are optional components. The components are described below in the order of the flow of the fluid.

Sample introduction part 111 is an inlet configured to introduce a sample into fluid handling device 100. In the present embodiment, sample introduction part 111 is composed of a through hole formed in substrate 101 and film 102 that closes the opening of the through hole on one side. The structure of sample introduction part 111 is not limited as long as the sample can be introduced into sample channel 112. In the present embodiment, two sample introduction parts 111 are provided, which are bottomed recesses that can receive the sample. In addition, the shape of sample introduction part 111 is not limited. In the present embodiment, sample introduction part 111 has a columnar shape.

Sample channel 112 is a channel connected to sample introduction part 111 and configured to carry the sample introduced to sample introduction part 111. In the present embodiment, sample channel 112 is composed of a groove formed in substrate 101 and film 102 that closes the opening of the groove. The structure of sample channel 112 is not limited as long as the sample can be appropriately carried. In the present embodiment, two sample channels 112 are provided as channels extending in the longitudinal direction and short direction of fluid handling device 100. The upstream end of sample channel 112 is connected to sample introduction part 111, and the downstream end of sample channel 112 is connected to dispersion liquid generation part 115. In addition, in the present embodiment, two sample channels 112 are joined to each other in a middle portion, and the joined sample channels 112 are connected to dispersion liquid generation part 115.

The cross-sectional shape of sample channel 112 is not limited, and may be any shapes such as a semicircular shape, a rectangular shape and a circular shape. Also, the cross-sectional size of sample channel 112 is not limited. Note that "cross section of the channel" as used herein means a cross section orthogonal to the flow direction of the channel.

Note that while fluid handling device 100 includes two sample introduction parts 111 and two sample channels 112 in the above-described example, the number of sample introduction part 111 and the number of sample channel 112 are not limited as long as the sample can be carried, and the number of may be, for example, one.

Dispersion medium introduction part 113 is an inlet configured to introduce a dispersion medium (e.g., oil) into fluid handling device 100. In the present embodiment, fluid handling device 100 is provided with two dispersion medium introduction parts 113, and each dispersion medium introduction part 113 is composed of a through hole formed in substrate 101 and film 102 that closes the opening of the through hole on one side. The structure of dispersion medium introduction part 113 is not limited as long as the dispersion medium can be introduced into dispersion medium channel 114. In the present embodiment, dispersion medium introduction part 113 is a bottomed recess that can receive the dispersion medium. In addition, the shape of dispersion medium introduction part 113 is not limited. In the present embodiment, dispersion medium introduction part 113 has a columnar shape.

Dispersion medium channel 114 is a channel connected to dispersion medium introduction part 113 and configured to carry the dispersion medium (e.g., oil) introduced to dispersion medium introduction part 113. In the present embodiment, fluid handling device 100 is provided with two dispersion medium channels 114, and each dispersion medium channel 114 is composed of a groove formed in substrate 101 and film 102 that closes the opening of the groove. In the present embodiment, dispersion medium channel 114 is a channel extending in the short direction of fluid handling device 100. The upstream end of one dispersion medium channel 114 is connected to one dispersion medium introduction part 113, and the downstream end of one of dispersion medium channel 114 is connected to dispersion liquid generation part 115. In addition, the upstream end of the other dispersion medium channel 114 is connected to the other dispersion medium introduction part 113, and the downstream end of the other dispersion medium channel 114 is connected to dispersion liquid generation part 115.

The cross-sectional shape of dispersion medium channel 114 is not limited, and may be any shapes such as a semicircular shape, a rectangular shape and a circular shape. Also, the cross-sectional size of dispersion medium channel 114 is not limited.

Note that while fluid handling device 100 includes two dispersion medium introduction parts 113 and two dispersion medium channels 114 in the above-described example, the number of dispersion medium introduction part 113 and the number of dispersion medium channel 114 are not limited as long as the sample can be divided, and the number may be, for example, one.

Dispersion liquid generation part 115, which is connected to sample channel 112 and dispersion medium channel 114, generates dispersion liquid in which droplets of the sample are dispersed in the dispersion medium by dividing the sample flowing through sample channel 112 with the dispersion medium flowed through dispersion medium channel 114. Dispersion liquid generation part 115 is configured by connecting dispersion medium channel 114 to sample channel 112. In the present embodiment, dispersion medium channel 114 is connected from both the left side and right side of sample channel 112, and droplets of the sample are generated when the sample flowing through sample channel 112 is divided by the dispersion medium flowing from both the left side and right side (see FIG. 5).

The size of the opening of sample channel 112 (the downstream end of sample channel 112) in dispersion liquid generation part 115 has an influence on the size of droplets, and in general, the diameter of a droplet is substantially the same as the opening of sample channel 112. In view of this, the size (depth and width) of the opening of sample channel 112 is appropriately selected in accordance with the desired diameter of the droplet.

The size of the opening of dispersion medium channel 114 (the downstream end of dispersion medium channel 114) in dispersion liquid generation part 115 has an influence on the size, number, generation yield and the like of droplets. In view of this, the size (depth and width) of the opening of dispersion medium channel 114 is appropriately selected in accordance with the type of the sample and the like.

Dispersion liquid generation part 115 includes protrusion 116. Protrusion 116 carries the sample flowed through sample channel 112 in such a manner that the sample sticks to the surface of protrusion 116. In this manner, protrusion 116 stably generates droplets by directing the flow of the sample such that adhesion of the flowing sample to the wall of dispersion liquid channel 117 is suppressed.

A part of protrusion 116 may be disposed outside dispersion liquid generation part 115 (e.g., inside sample channel 112), but at least a part of protrusion 116 is disposed in dispersion liquid generation part 115. In addition, preferably, at least an upstream (sample channel 112 side) portion of protrusion 116 is located at a position where the sample flowed through sample channel 112 makes contact. When the sample makes contact with the upstream portion of protrusion 116, the flow of the sample is directed such that the sample thereafter flows in such a manner as to stick to the side surface of protrusion 116. On the other hand, preferably, the downstream (dispersion liquid channel 117 side) end portion of protrusion 116 is located inside the channel width (or an extension of the channel width) of dispersion liquid channel 117. When the downstream end portion of protrusion 116 is located inside the channel width of dispersion liquid channel 117, adhesion of the flowing sample to the wall of dispersion liquid channel 117 can be suppressed.

The shape of protrusion 116 is not limited as long as the sample can flow in such a manner as to stick to its surface and the sample can be directed. Preferably, protrusion 116 is bilaterally symmetric as illustrated in the plan views of FIGS. 4 and 5, for example. More specifically, preferably, protrusion 116 is line-symmetric with respect to a line connecting the center of sample channel 112 in the width direction at the connecting part of sample channel 112 and dispersion liquid generation part 115 (the opening of sample channel 112 in dispersion liquid generation part 115), and the center of dispersion liquid channel 117 in the width direction at the connecting part (the opening of dispersion liquid channel 117 in dispersion liquid generation part 115) of dispersion liquid channel 117 and dispersion liquid generation part 115. In addition, preferably, protrusion 116 includes a tapered portion configured to facilitate the merging of the sample flowed from its left and right sides on its downstream side. The "tapered portion" means a portion whose width decreases from the upstream side (sample channel 112 side) toward the downstream side (dispersion liquid channel 117 side). Preferably, this tapered portion is thinned toward the center of the channel width of dispersion liquid channel 117. In this manner, the sample flows through the center of the channel, and adhesion of the flowing sample to the wall of dispersion liquid channel 117 is suppressed.

In addition, preferably, the upstream (sample channel 112 side) portion of protrusion 116 has a certain large surface area for the purpose of directing the flow of the sample by increasing the amount of the sample that sticks to the surface of protrusion 116. On the other hand, preferably, the downstream (dispersion liquid channel 117 side) portion of protrusion 116 includes a tapered portion for the purpose of merging the sample flowed through the periphery of protrusion 116. As a result, preferably, the downstream side of protrusion 116 has a relatively smaller surface area than its upstream side. In addition, as a result, preferably, protrusion 116 as a whole has a tapered shape thinned from the upstream side toward the downstream side in plan view. More specifically, protrusion 116 has a water-drop shape as illustrated in the plan views of in FIGS. 4 and 5, for example. Other examples of the shape of protrusion 116 in plan view are illustrated in FIGS. 6A to 6I.

In addition, the portion between the upstream portion and the downstream portion in protrusion 116 has no abrupt angular change in view of facilitating the flow of the sample along the surface. Preferably, a smooth curved surface or a flat surface is provided between the upstream portion and the downstream portion of protrusion 116, for example. In addition, preferably, protrusion 116 is slender from a view point of directing the flow of the sample. More specifically, preferably, the length in the fluid flowing direction (the length perpendicular to the channel width direction) is longer than the length in the channel width direction (the length in the direction of the sample channel width or the dispersion liquid channel width).

In addition, preferably, in plan view of fluid handling device 100, at least a part of protrusion 116 is located on a line connecting the center of sample channel 112 in the width direction at the connecting part of sample channel 112 and dispersion liquid generation part 115 (the opening of sample channel 112 in dispersion liquid generation part 115), and the center of dispersion liquid channel 117 in the width direction at the connecting part of dispersion liquid channel 117 and dispersion liquid generation part 115 (the opening of dispersion liquid channel 117 in dispersion liquid generation part 115). More specifically, preferably, the symmetric axis of protrusion 116, which is line-symmetric in plan view, is located on the above-mentioned line. In this manner, the sample can be carried at the center of the channel, and adhesion of the flowing sample to the wall of dispersion liquid channel 117 can be suppressed.

The three-dimensional shape of protrusion 116 is not limited, and examples of the three-dimensional shape of protrusion 116 include a columnar shape and a conical shape. That is, the horizontal cross section of protrusion 116 may be the same or different from the bottom to the top of the protrusion.

The height of protrusion 116 is not limited. It suffices that in the cross section of dispersion liquid channel 117, the height of protrusion 116 is the same as the height of the channel, or approximately 80% to 50% of the height of the channel, for example.

Preferably, protrusion 116 is a structure protruded from substrate 101 (the bottom surface of the groove) from a view point of the ease of manufacture. In addition, protrusion 116 may be a structure protruded from the film 102 side.

Dispersion liquid channel 117 is a channel connected to dispersion liquid generation part 115 and configured to carry dispersion liquid containing the droplet generated at dispersion liquid generation part 115. In the present embodiment, dispersion liquid channel 117 is composed of a groove formed in substrate 101 and film 102 that closes the opening of the groove. The structure of dispersion liquid channel 117 is not limited as long as the droplet can be appropriately carried. In the present embodiment, dispersion liquid channel 117 is a channel contiguous with sample channel 112 and extends in the longitudinal direction of fluid handling device 100. The upstream end of dispersion liquid channel 117 is connected to dispersion liquid generation part 115, and the downstream end of dispersion liquid channel 117 is connected to dispersion liquid collection part 118.

The cross-sectional shape of dispersion liquid channel 117 is not limited, and may be any shapes such as a semicircular shape, a rectangular shape and a circular shape. Preferably, the cross-sectional size (depth and width) of dispersion liquid channel 117 is equal to or greater than the cross-sectional size (depth and width) of sample channel 112 so as not to interfere with droplet movement.

Dispersion liquid collection part 118 is an outlet connected to dispersion liquid channel 117 and configured to collect dispersion liquid containing droplets. In the present embodiment, dispersion liquid collection part 118 is composed of a through hole formed in substrate 101 and film 102 that closes the opening of the through hole on one side. The structure of dispersion liquid collection part 118 is not limited as long as dispersion liquid containing droplets can be collected. In the present embodiment, dispersion liquid collection part 118 is a bottomed recess that can house the dispersion liquid. In addition, the shape of dispersion liquid collection part 118 is not limited. In the present embodiment, dispersion liquid collection part 118 has a columnar shape. The size of dispersion liquid collection part 118 may be appropriately set in accordance with the amount of the dispersion liquid to be collected.

Fluid Handling Method

Next, a method (fluid handling method) of generating and collecting droplets of a sample using fluid handling device 100 according to the present embodiment is described.

First, a sample is introduced to sample introduction part 111, and a dispersion medium (e.g., oil) is introduced to two dispersion medium introduction parts 113.

The above-mentioned sample is, for example, liquid to be sorted as a droplet, or liquid containing a sorting object to be sorted in a state encapsulated in a droplet. Examples of the sample include liquids containing cells, proteins, or nucleic acids. In addition, the sample may contain dispersion solvent for dispersing sorting objects such as the above-mentioned cells, proteins and nucleic acids.

The above-mentioned dispersion medium is not limited as long as the compatibility with the sample is low, and the sample flowing through sample channel 112 can be divided in dispersion liquid generation part 115.

The sample flows through sample channel 112 by being pressurized in sample introduction part 111, and the dispersion medium flows through dispersion medium channel 114 by being pressurized in dispersion medium introduction part 113. Alternatively, the sample and dispersion medium may be taken into sample channel 112 and dispersion medium channel 114 by being depressurized in dispersion liquid collection part 118.

As illustrated in FIG. 5, in dispersion liquid generation part 115, the sample flowing from sample channel 112 flows in such a manner as to stick to protrusion 116. Then, the sample is divided by the dispersion medium flowed through two dispersion medium channels 114. In this manner, the sample becomes a droplet surrounded by the dispersion medium, and dispersion liquid in which droplets of the sample are dispersed in the dispersion medium is generated.

Figure 2:
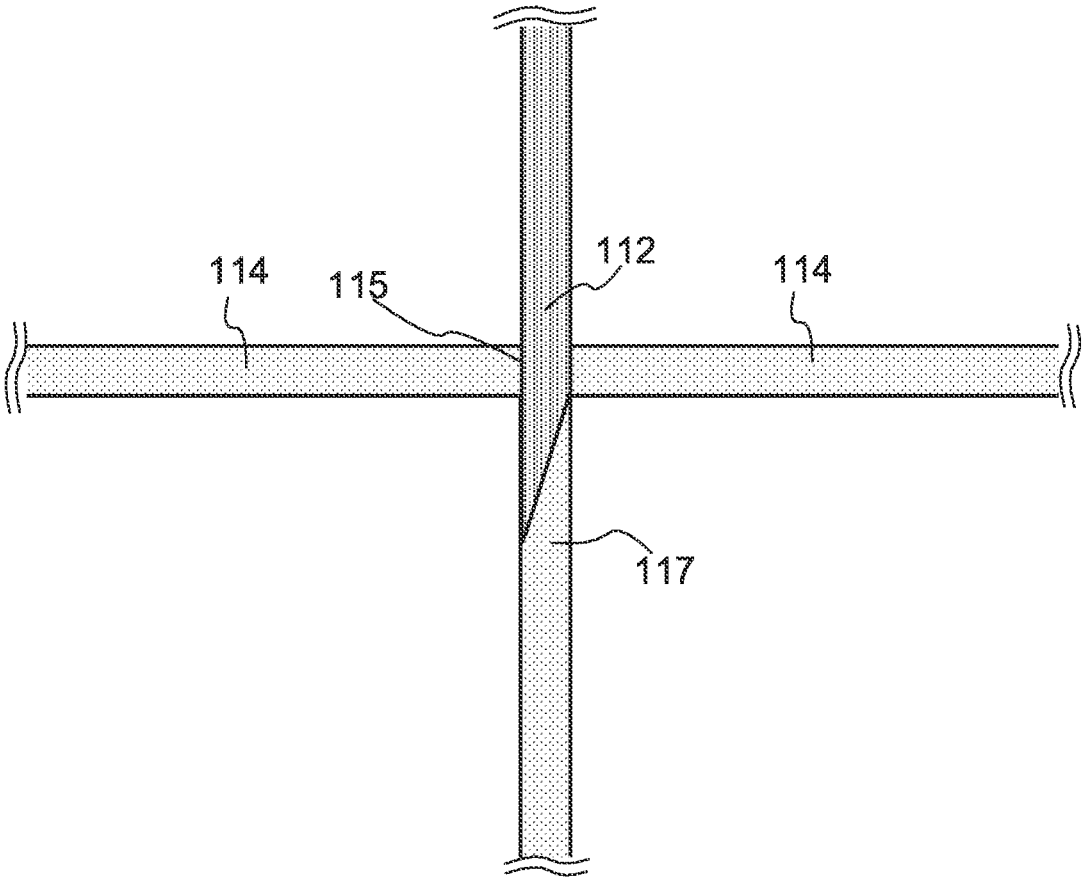
FIG. 2 illustrates a state where no droplets are generated due to a laminar flow of a sample in a conventional fluid handling device.

As described above, the sample flows in such a manner as to stick to protrusion 116. In this manner, adhesion of flowing sample to the wall of dispersion liquid channel 117 as illustrated in FIG. 2 is suppressed, and failure of generation of droplets is suppressed.

Effect

The fluid handling device according to the present invention can generate droplets more stably. In particular, flowing samples with high viscosity tend to adhere to the wall of dispersion liquid channel 117. Therefore, the fluid handling device according to the present invention is especially suitable for samples with high viscosity.

INDUSTRIAL APPLICABILITY

The fluid handling device and the fluid handling method of the present invention are applicable to laboratory tests, food tests, and environment tests, for example.

REFERENCE SIGNS LIST

100 Fluid handling device
101 Substrate
102 Film
111 Sample introduction part
112 Sample channel
113 Dispersion medium introduction part
114 Dispersion medium channel
115 Dispersion liquid generation part
116 Protrusion
117 Dispersion liquid channel
118 Dispersion liquid collection part

The invention claimed is:

1. A fluid handling device comprising:

a sample channel configured to carry a sample;

a dispersion medium channel configured to carry dispersion medium;

a dispersion liquid generation part connected to the sample channel and the dispersion medium channel, and configured to generate dispersion liquid by dividing the sample by the dispersion medium the dispersion liquid being liquid in which droplets of the sample are dispersed in the dispersion medium; and a dispersion liquid channel connected to the dispersion liquid generation part, wherein the dispersion liquid generation part includes a protrusion, and wherein in plan view of the fluid handling device, at least a part of the protrusion is located on a line connecting a center of the sample channel in a width direction at a connecting part of the sample channel and the dispersion liquid generation part, and a center of the dispersion liquid channel in the width direction at a connecting part of the dispersion liquid channel and the dispersion liquid generation part.

2. The fluid handling device according to claim 1, wherein the protrusion is line-symmetric with respect to the line.

3. A fluid handling device comprising:

a sample channel configured to carry a sample;

a dispersion medium channel configured to carry dispersion medium;

a dispersion liquid generation part connected to the sample channel and the dispersion medium channel, and configured to generate dispersion liquid by dividing the sample by the dispersion medium, the dispersion liquid being liquid in which droplets of the sample are dispersed in the dispersion medium; and a dispersion liquid channel connected to the dispersion liquid generation part, wherein the dispersion liquid generation part includes a protrusion, and wherein the protrusion includes a tapered portion whose width decreases from a sample channel side toward a dispersion liquid channel side.

4. The fluid handling device according to claim 1, wherein the protrusion is a columnar member or a conical member.

* * * * *